United States Patent [19]

Tanaka et al.

[11] Patent Number: 4,590,976

[45] Date of Patent: May 27, 1986

[54] EXHAUST APPARATUS FOR ELECTRIC LAMPS

[75] Inventors: Kazuyuki Tanaka, Yokohama; Noriaki Nishigaki, Yokosuka, both of Japan

[73] Assignee: Kabushiki Kaisha Toshiba, Kawasaki, Japan

[21] Appl. No.: 665,343

[22] Filed: Oct. 26, 1984

[30] Foreign Application Priority Data

Oct. 28, 1983 [JP] Japan ..... 58-202322

[51] Int. Cl.[4] ..... B65B 3/04

[52] U.S. Cl. ..... 141/66; 141/269; 251/7

[58] Field of Search ..... 141/1-12, 141/36-66, 250-284; 251/4-10

[56] References Cited

FOREIGN PATENT DOCUMENTS 1057057 9/1975 Japan .

57-57450 6/1982 Japan ..... 141/66

*Primary Examiner*—Houston S. Bell, Jr.

*Attorney, Agent, or Firm*—Cushman, Darby and Cushman

[57] ABSTRACT

An exhaust apparatus for fluorescent lamps has a transferring conveyor which intermittently conveys several carriers. Each of the carriers has several support heads to support bulbs which are connected through exhaust tubes to first connecting pipe members. Working heads are successively located at predetermined positions along the conveyor. Each of the working heads has second connecting pipe members which are detachably connected to the first connecting pipe members, respectively. Further, first and second valves are attached to the first and second connecting pipe members to open and close inner passages in the first and second connecting pipe members.

11 Claims, 9 Drawing Figures

EXHAUST APPARATUS FOR ELECTRIC LAMPS

BACKGROUND OF THE INVENTION

The present invention relates to an apparatus used in the manufacturing of electric lamps and, more particularly, to an exhaust apparatus suitable for exhausting the bulbs of fluorescent lamps.

In manufacturing ring-shaped fluorescent lamps, the straight or elongated bulb made of lead glass is softened by heating and then is shaped in a ring by the bending machine. The bulbs thus shaped are fed to the exhaust apparatus, where the bulb exhaust step is done. This bulb exhaust step includes a process of introducing materials such as mercury and argon in the bulbs through their exhaust tubes, tipping off and closing their exhaust tubes, as well as exhausting the bulbs through their exhaust tubes. After this exhaust step, aging and base-attaching processes are applied to the bulbs to make the ring-shaped fluorescent lamps complete.

In the above-described procedure, it is desired that the time necessary for processing one of the bulbs be shortened to enhance productivity.

The exhaust apparatus for ring-shaped fluorescent lamps disclosed by Japanese Patent Publication No. 51-392 is well-known and is used in the exhaust step to enhance productivity. In this well-known exhaust apparatus, bulbs are attached to the front ends of radially extending support arms and the exhaust step is effected as the support arms intermittently rotate. This well-known exhaust apparatus is intended to shorten the exhaust time per bulb in the exhaust step in such a way that two of the support arms are paired to exhaust two bulbs at the same time.

In this rotary exhaust apparatus, a center plate or valve is used to change the passages which are connected to the exhaust tubes when exhausting the bulbs and introducing the materials within. However, in order to exhaust two bulbs simultaneously the internal structure of the center valve must become more complicated. In addition, since two bulbs are synchronizingly and intermittently conveyed to exhaust two bulbs at the same time, the circumference or radius of the exhaust apparatus must be large, making the overall apparatus large-sized. The complexity of the structure of the center valve and the largeness of the overall exhaust apparatus become even more intensified as the number of bulbs which are to be exhausted simultaneously is increased. Further, since the rotary exhaust apparatus is a circle, the floor on which it is installed cannot be effectively used.

SUMMARY OF THE INVENTION

The object of the present invention is to provide an exhaust apparatus for electric lamps capable of the bulb exhaust step by exhausting several bulbs simultaneously in the course of simultaneously and intermittently conveying them, and which is not limited spatially.

This object of the present invention can be attained by constructing an exhaust apparatus for electric lamps of a carrier for supporting and conveying several electric lamp bulbs, each having an exhaust tube extending from it. This carrier should include bases having several support heads attached to support the bulbs. The support head should have a chuck means for holding each bulb; first connecting pipe members having an internal passage connected to the exhaust tube of each bulb that is held by the chuck means, the first connecting pipe member each having a first connecting port at one end thereof to be connected to the opened end of the exhaust tube, and a second connecting port opened at the other end thereof; and a first valve means for opening and closing the internal passage of the first connecting pipe members. The exhaust apparatus should also have conveyor means for conveying the carrier and having an endless guide rail for guiding the carrier, and several working heads successively fixed along the guide rail of the conveyor means and connected to the working means to perform each of processes in the exhaust step. The working head should include a second connecting pipe members equal in number to the first connecting pipe members in the carrier. The second connecting pipe should also be provided with an internal passage connected to that of the first connecting pipe member. The second connecting pipe member should have a connecting port at one end thereof connectable to the second connecting port of the first connecting pipe member, and connected at the other end thereof to its corresponding working means. Connector means detachably connects the second connecting pipe member to its corresponding first connecting pipe member when the carrier is conveyed and positioned at the working head, and a second valve means opens and closes the internal passage in the second connecting pipe members.

According to the present invention, several support heads are attached to the carrier to be movable along the guide rail. A working head for performing each of process in the exhaust step is located at a predetermined position of the guide rail, thereby enabling the bulbs held by support heads on the carrier to be conveyed at the same time. The support heads cooperate with their corresponding working heads at predetermined positions along the rail to perform each of the processes in the exhaust step simultaneously as the bulbs are conveyed. Therefore, the exhaust apparatus of the present invention is suitable for the mass production of electric lamps. According to the present invention, the numbers of support heads on the carrier and of the second connecting pipe members in the working head may only be increased to increase the number of bulbs simultaneously treated in the exhaust process, thereby enabling the present invention to be easily embodied from the viewpoint of structure.

In addition, the exhaust apparatus of the present invention allows the endless guide rail for conveying and guiding the carrier to be made in any form, thereby permitting the floor which the apparatus is installed to be effectively used, as compared with the conventional exhaust apparatus which uses a center valve.

DETAILED DESCRIPTION OF THE PREFERRED EMBODIMENT

Figure 1:
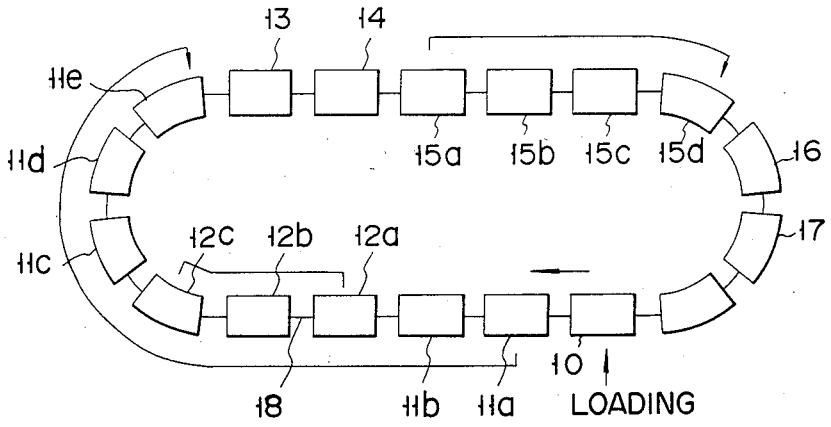
FIG. 1 is a rough sketch showing the entire system in which the exhaust apparatus of the present invention is included.

FIG. 1 is a block diagram showing the whole of the system in which an example of the exhaust apparatus according to the present invention is used in ring-shaped fluorescent lamps. Bulbs are loaded at a loading position 10, and then are exhausted at exhaust positions 11*a*–11*e*. These bulbs have been already shaped in a ring by the bending machine (not shown). A lighting process is applied to the bulbs at the lighting positions 12*a*–12*c* shown in FIG. 1 as the bulbs are exhausted at the exhaust positions 11*a*–11*e*. Current is applied to cathodes in the bulbs in this lighting process to decompose oxide material attached to the cathodes.

The bulbs exhausted at the exhaust positions 11*a*–11*e* are then successively conveyed to mercury and argon gas introducing positions 13 and 14 where mercury and argon gas are introduced in the bulbs. Thereafter, the exhaust tubes of the bulbs are chopped off and closed at chopping-off positions 15*a*–15*d*, aging is applied to the bulbs at an aging position 16, and the bulbs are then unloaded at an unloading position 17.

It must be noted here that the ring-shaped fluorescent lamp exhaust step includes all of the processes starting from the exhaust position and ending in the chopping-off position.

Referring to FIGS. 2 through 9, an example of the exhaust apparatus according to the present invention will be described in detail in relation to its structure. A conveyor 18 is arranged along the working positions shown in FIG. 1. This conveyor 18 is provided with an endless guide rail 19 extending along the working positions. Carriers 20 are movably attached to the guide rail 19. Namely, these carriers 20 are provided with a base plate 22 which is connected to an endless chain 21 and which cooperates with the guide rail 19 to form the conveyor 18. This running chain 21 is intermittently driven by a drive source (not shown) to thereby move the base plate or carriers 20 intermittently along the guide rail 19. Each of the carriers 20 is intermittently conveyed to temporarily and successively stop at each of the working positions shown in FIG. 1. As shown by the broken line in FIG. 3, a second guide rail 23 extending along the guide rail 19 may be added to stabilize the intermittent conveyance of the carriers 20.

Figure 3:
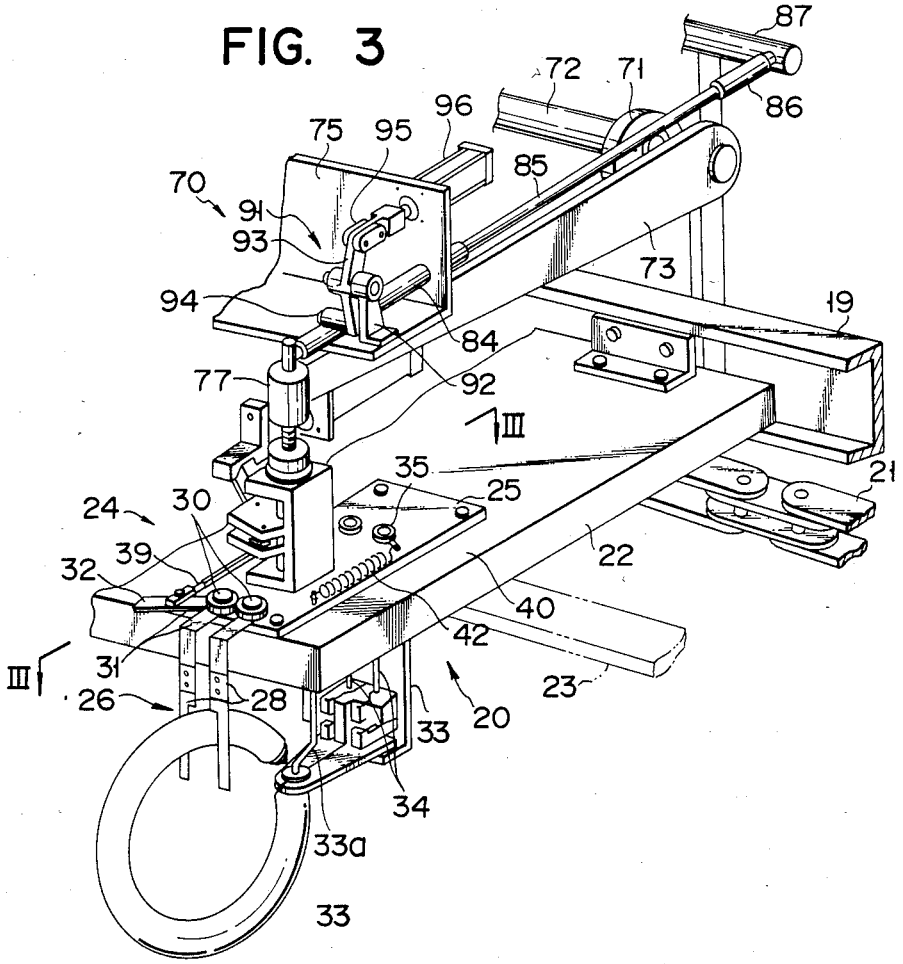
FIG. 3 is a perspective view showing an enlarged part of FIG. 3.
Figure 2:
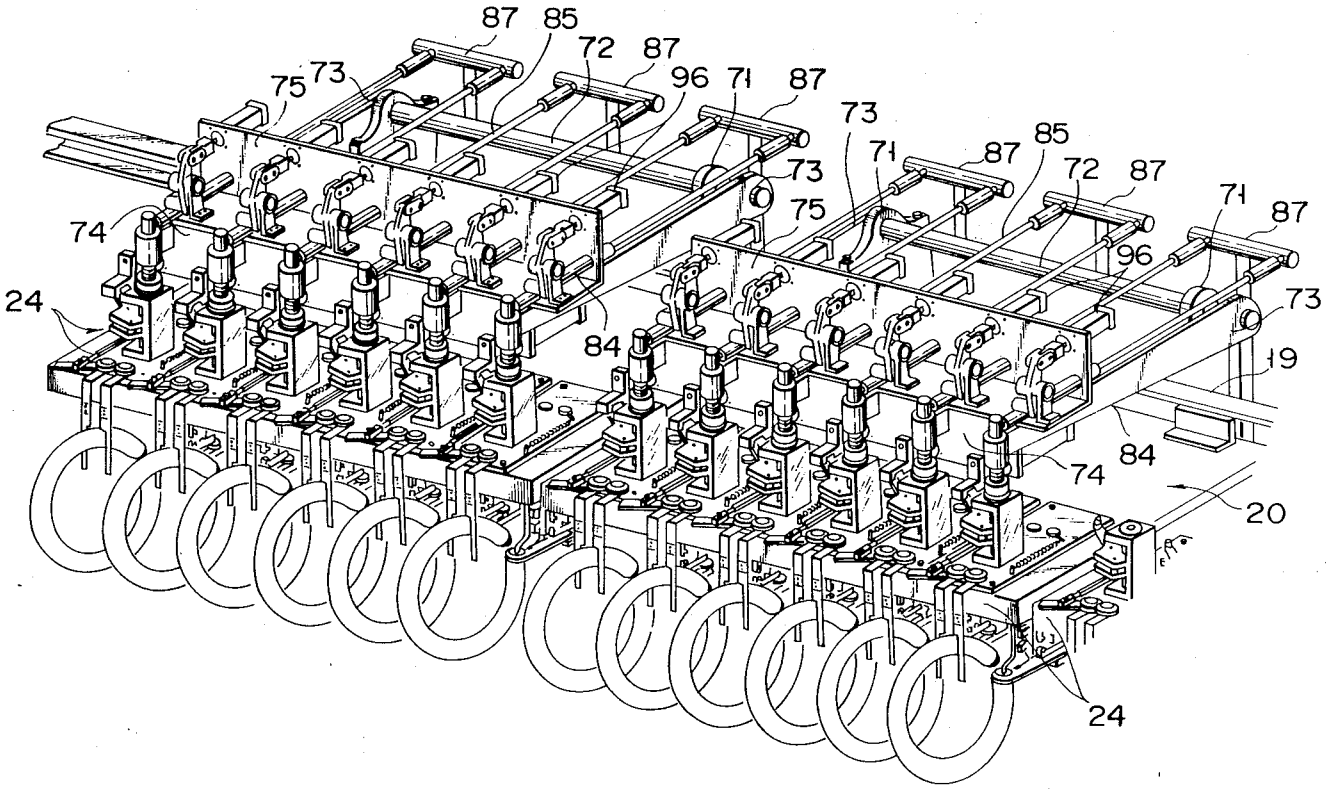
FIG. 2 is a perspective view showing an embodiment of the present invention in which the carrier provided with several support heads is positioned to correspond to the working heads.
Figure 4:
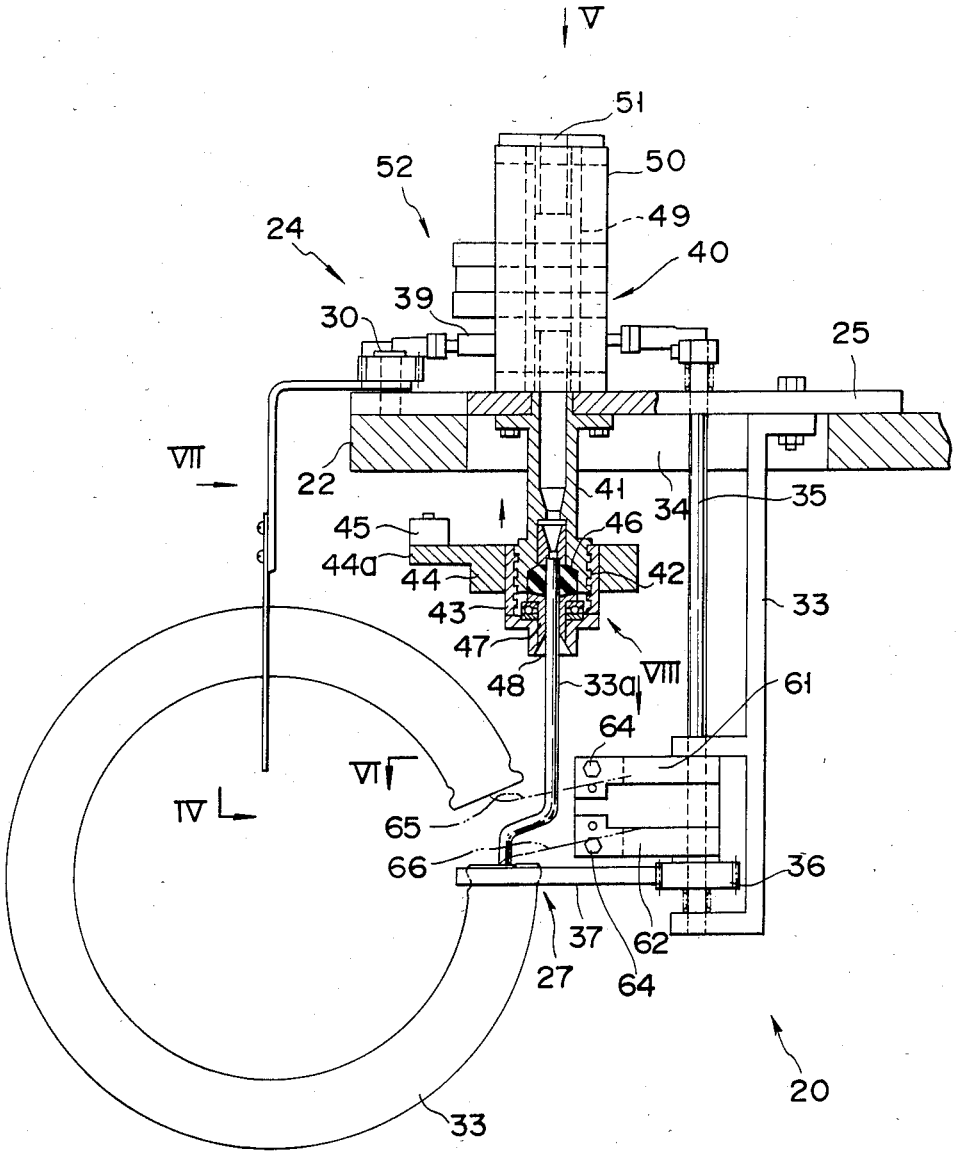
FIG. 4 is a sectional view taken along the line IV—IV in FIG. 3.

As shown in FIG. 2, six support heads 24, are arranged in a line along the side edge of the base plate 22 which is most remote from the guide rail 19. This support head 24 is best shown in FIGS. 3 through 8. The support head 24 has an attachment plate 25 fixed onto the base plate 22. The first bulb chuck 26 has a pair of chuck claws 28 which have an elongated plate shape. The proximal ends of these chuck claws 28 are fixed to rotary pins 30 which are rotatably attached to the attachment plate 25, while the other front end thereof extend horizontally and then downward. Spur gears 31 which are engaged with each other are attached to the rotary pins 30. Further, one end of a lever 32 is connected to one of the rotary pins 30. In the first bulb chuck 26, therefore, the chuck claws 28 are separated from each other and open in a direction B in FIG. 5 through the paired spur gears 31 and the paired rotary pins 30 when the lever 32 is rotated in direction A in FIG. 5. When the lever 32 is rotated reverse to direction A, the chuck claws 28 are closed. The chuck claws 28 can thus hold the ring-shaped bulb 33, as shown in FIGS. 3 and 4.

Figure 5:
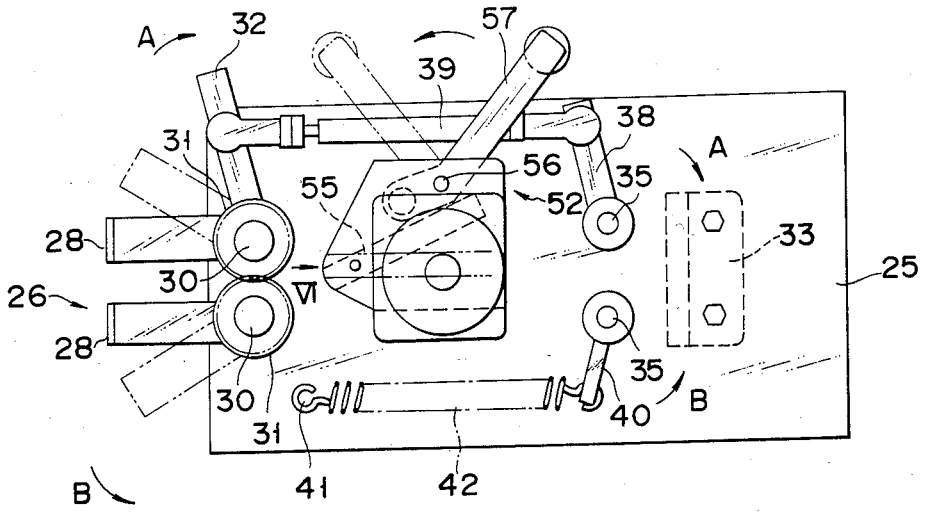
FIG. 5 is viewed from a direction V in FIG. 4.
Figure 8:
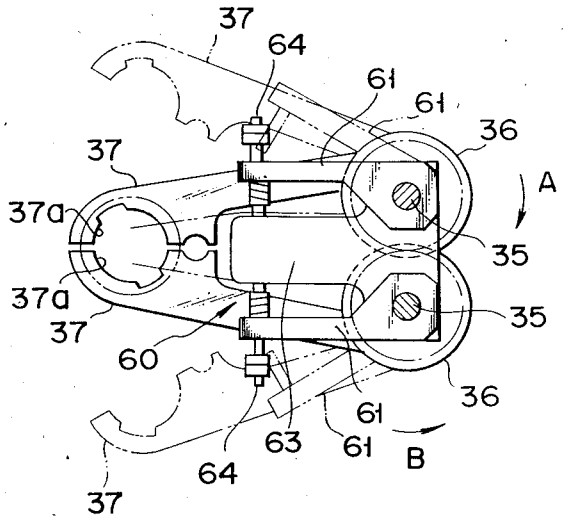
FIG. 8 is a plan view showing the bulb chuck viewed from a direction VIII in FIG. 4.
Figure 7:
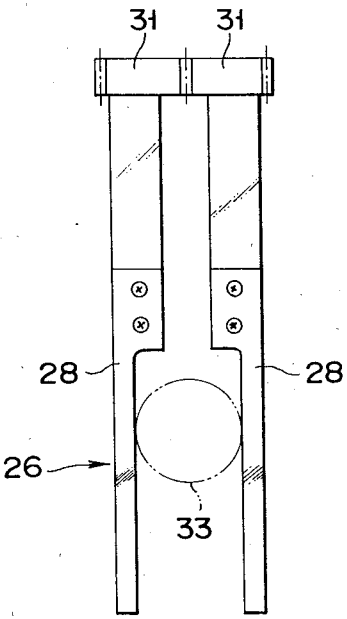
FIG. 7 is a front view showing a bulb chuck viewed from a direction VII in FIG. 4.

Another second bulb chuck 27 is provided with a hanging plate 27*a* positioned nearer to the guide rail 10 than the first bulb chuck 26. The upper end of this hanging plate 27*a* is fixed to the underside of the attachment plate 25, while the other end thereof extends downward through an opening 34 in the base plate 22. Extending parallel to the hanging plate 27*a*, a pair of rotary shafts 35 is located on the side of the first bulb chuck 26. The upper end of this rotary shaft 35 extends upward through the opening 34 and the attachment plate 25, while the lower end thereof is rotatably supported by the lower end portion of the hanging plate 27*a*. A pair of spur gears 36 which are engaged with each other is attached to the lower ends of these rotary shafts 35. The proximal ends of the paired chuck arms 37 are attached to these spur gears 36, while the distal ends thereof extend horizontally toward the first bulb chuck 26. Formed at the distal portions of these chuck arms 37 are semi-circular cut-off portions 37*a*, which define a substantially circular opening, as shown in FIG. 8, when the chuck arms 37 are closed. One end of a lever 38 is connected to the upper end of one of the rotary shafts 35 which project through the attachment plate 25. The other end of this lever 38 is connected to the lever 32 of the first bulb chuck 26 through a link 39, as shown in FIG. 5. A lever 40 is also connected to the upper end of the other rotary shaft 35 which also projects through the attachment plate 25, and a return spring 40 is interposed between the lever 40 and a pin 41 erected on the attachment plate 25. When the lever 32 of the first bulb chuck 26 is rotated in direction A, therefore, the chuck claws 28 of the first bulb chuck 26 are opened as described above, and the lever 38 is also rotated in direction A through the rotation of the lever 32 through the link 39. One rotary shaft 35 which is connected to the lever 38 is thus rotated in direction A, while the other rotary shaft 35 is rotated in direction B which is the reverse of direction A due to the engaged pair of spur gears 36. As a result, the paired chuck arms 37 of the second bulb chuck 27 are separated from each other and opened, as were the chuck claws 28, and as shown by the broken lines in FIG. 8. It should be understood that the chuck arms 37 can close the same way as the chuck claws 28 close when the lever 32 is rotated in the direction reverse to that of direction A.

The bulb 33 is held simultaneously by the chuck claws 28 and chuck arms 37 of the first and second bulb chucks 26 and 27, as described above. To explain in more detail, one end of the ring-shaped bulb 33 from which the exhaust tube 33*a* extends is held by the chuck arms 37. That portion of the ring-shaped bulb 33, which is shifted by about 90° along the circumference as viewed from the bulb 33, is held by the chuck claws 28. Moreover, the ring-shaped bulbs 33 which are held as shown in FIG. 2 are fed to the loading position 10 by means of a transfer apparatus (not shown), and are delivered to the support heads 24 on the carrier 20 at the loading position 10.

Each of the support heads 24 on the carrier 20 is provided with a first connecting pipe member 40 which can be connected to the exhaust tube 33*a* of the bulb 33 supported by the support head 24. This first connecting pipe member 40 will be described below. The first connecting pipe member 40 has a connecting metal pipe 41, which is fixed to the attachment plate 25, with its upper end projecting from the attachment plate 25, and with its lower end extending downward and toward the second bulb chuck 27. Formed at the lower end portion of the connecting pipe 41 is a thread 42 onto which a nut 43 is screwed. A pipe portion 43*a* is projected downward from the underside of the nut 43. A ring 44 is made integral to the nut 43. A radially-extended portion 44*a* is formed on the outer circumference of the ring 44, and a roller 45 is mounted on the upper surface of this extended portion 44*a*. A ring-shaped fastening rubber 46 is fitted inside the lower portion of the connecting pipe 41. A pipe-shaped press member 48 is attached inside the nut 43 through a bearing 47.

When the exhaust tube 33*a* of the bulb 33 is fitted into the fastening rubber 46, it passes through the projected pipe portion 43*a* of the nut 43 of the press member 47, as shown in FIG. 3. Therefore, the roller 45 is pushed by a press means such as the pneumatic cylinder (not shown) and the nut 43 is rotated through the ring 44. That is, the press member 47 is thus lifted to press the fastening rubber 46, and the exhaust tube 33*a* of the bulb 33 can be air-tightly clamped by the fastening rubber 46. The bulb 33 is held by the first and second bulb chucks 26 and 27 in such a way that its exhaust tube 33*a* is fitted inside the press member and fastening rubber 46.

On the other hand, air-tightly connected to the upper end of the connecting pipe 41 which is projected from the attachment plate 25 is a rubber tube 49, the upper end of which is air-tightly connected to a pipe-shaped connector 51 which is fixed on a support block 50 erected on the attachment plate 25. Because the exhaust tube 33*a* of the bulb 33 is air-tightly clamped by the fastening rubber 46 through the press member 47 in the nut 43, as described above, the exhaust tube 33*a* is connected to the connector 51 through the connecting pipe 41 and rubber tube 49.

Figure 6:
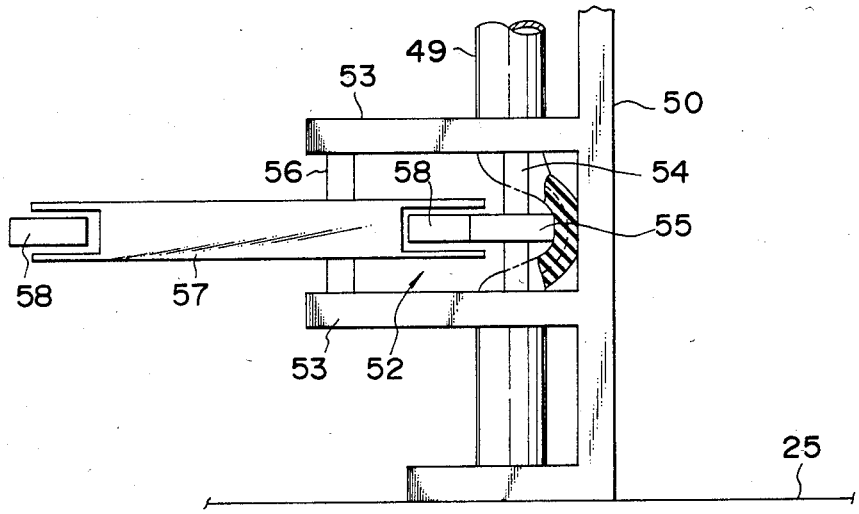
FIG. 6 is a view showing a first pinch cock viewed from the direction VI in FIG. 5.

A first pinch cock 52 is arranged in the support block 50 to open and close the internal passage of the first connecting pipe member 40, i.e., the rubber tube 49. As shown in FIGS. 5 and 6, the first pinch cock 52 has a press lever 55 rotatably arranged between a pair of arms 53 through a pin 54, the arms 53 projecting from the support block 50. The press lever 55 is operated by a rotary lever 57 which is rotatably arranged between the arms 53 on the support block 50 through a pin 56. When the rotary lever 57 is rotated counterclockwise by an actuator, such as the pneumatic cylinder (not shown), taking the pin 56 as its center, that end of the rotary lever 57 which is located on the side of the press lever 55 is contacted with the press lever 55 to rotate the press lever 55 clockwise. As shown in FIG. 6, the rubber tube 49 is thus sandwiched and crushed between the press lever 55 and the support block 50, thereby causing the inner passage in the rubber tube 49 to be closed. When the rotary lever 57 is rotated clockwise and returned to the state shown in FIG. 5, the rubber tube 49 returns to its original shape due to its elasticity, thereby causing the inner passage thereof to be opened. A return spring may be interposed between the press lever 55 and the attachment plate 25, if necessary. Rollers 58 are attached to both ends of the rotary lever 57 for the purpose of allowing the rotary lever 57 to be smoothly rotated by the actuator and allowing the press lever 55 to be smoothly rotated by the rotary lever 57.

A lead wire chuck 60 is arranged at the support head 24 as shown in FIG. 8. The lead wire chuck 60 has two pairs of chuck levers 61 and 62. These chuck levers are attached to each of the rotary shafts 35 and are separated from each other in the vertical direction. The two pairs of chuck levers 61 and 62 rotate integrally with the rotary shafts 35. In other words, the two pairs of chuck levers 61 and 62 are rotated together with the bulb chuck arms 37. An electric insulating member 63 is arranged between the paired chuck levers 61, and between the paired chuck levers 62, respectively, as shown in FIG. 8. These electric insulating members 63 are supported by the rotary shafts 35. The electric insulating members 63 are not rotated even when the rotary shafts 35 are rotated. A terminal 64 is attached to each of the two pairs of chuch levers 61 and 62. When one pair of the chuck levers 61 is rotated, two lead wires 65*a* of a filament coil are clamped between the terminals 64 of the chuck levers 61 and the insulating member 63, the lead wires 65 extending from one end of the bulb 33. When other pair of the chuck levers 62 is rotated, two lead wires 66 of a filament coil are clamped between the terminals 64 of the chuck levers 62 and the insulating member 63, the lead wires 66 extending from the other end of the bulb 33. The lead wires 65 and 66 are adapted in such a way that they can be clamped between the terminals 64 of the chuck levers 61 and the insulating member 63, and also between the terminals 64 of the chuck levers 62 and the insulating member 63 prior to holding the bulb 33 by the first and second bulb chucks 26 and 27.

Working heads 70 which are fixed at the working positions 11*a*–11*e*, 13 and 14 will be described below. The working heads 70 have fundametally the same structure, and therefore, the one which serves to exhaust the bulb 33 will be described by referring to FIGS. 2, 3 and 9. This working head 70 is provided with two support stands 71 which are located opposite the carrier conveyed along the rail 19 and which are separated from each other in the conveying direction of the carrier 20. A rotary shaft 72 which extends parallel to the guide rail 19 is supported between the support stands 71. Support arms 73 which extend toward the support heads 24 on the carrier 20 are attached to both ends of the rotary shaft 72 which project from the support stands 71. Although only those support arms 73 which correspond to the support heads on the both sides of the carrier 20 when viewed in the conveying direction of the carrier 20 are shown in FIG. 2. The support arms 73 are the same in number as the support heads 24 on the carrier 20. The front ends of these support arms 73 are connected to a head plate 74 which extends along the guide rail 19. An angle-shaped support plate 75 which extends parallel to the head plate 74 is fixed on the support arms 73 between the head plate 74 and the rotary shaft 72.

Second connecting pipe members 76 which have the same number as the support heads 24 on the carrier 20 are arranged at the working head 70. The second connecting pipe member 76 has a metal connecting pipe 78 which loosely passes through a pipe section 77 integral to the front end of its corresponding support arm 73. Formed at the lower end of the connecting pipe 78 is a flange 79, on the outer circumference of which a thread 80 is formed. A nut 81 is screwed onto the thread 80 on the flange 79. A ring-shaped seal rubber 82 is arranged at the underside of the flange 79, enclosing a connecting port 78*a* which is opened at the underside of the connecting pipe 78. The seal rubber 82 extends downward, passing through the bottom of the nut 81. A spring 83 is interposed between the underside of the pipe section 77 of the support arm 73 and the upper surface of the flange 79.

The upper portion of the connecting pipe 78 which projects upward from the pipe section 77 is bent to horizontally extend toward the proximal end of the support arm 73, and is air-tightly connected to a rubber tube 84 which passes through the support plate 75. The rubber tube 84 is further connected to a connecting pipe 87 through a connecting pipe 85 and a rubber tube 86. The connecting pipe 87 is connected to a vacuum pump 88 in this case. As apparent from FIG. 2, the two second connecting pipe members 76 are paired and connected to the connecting pipe 87.

Figure 9:
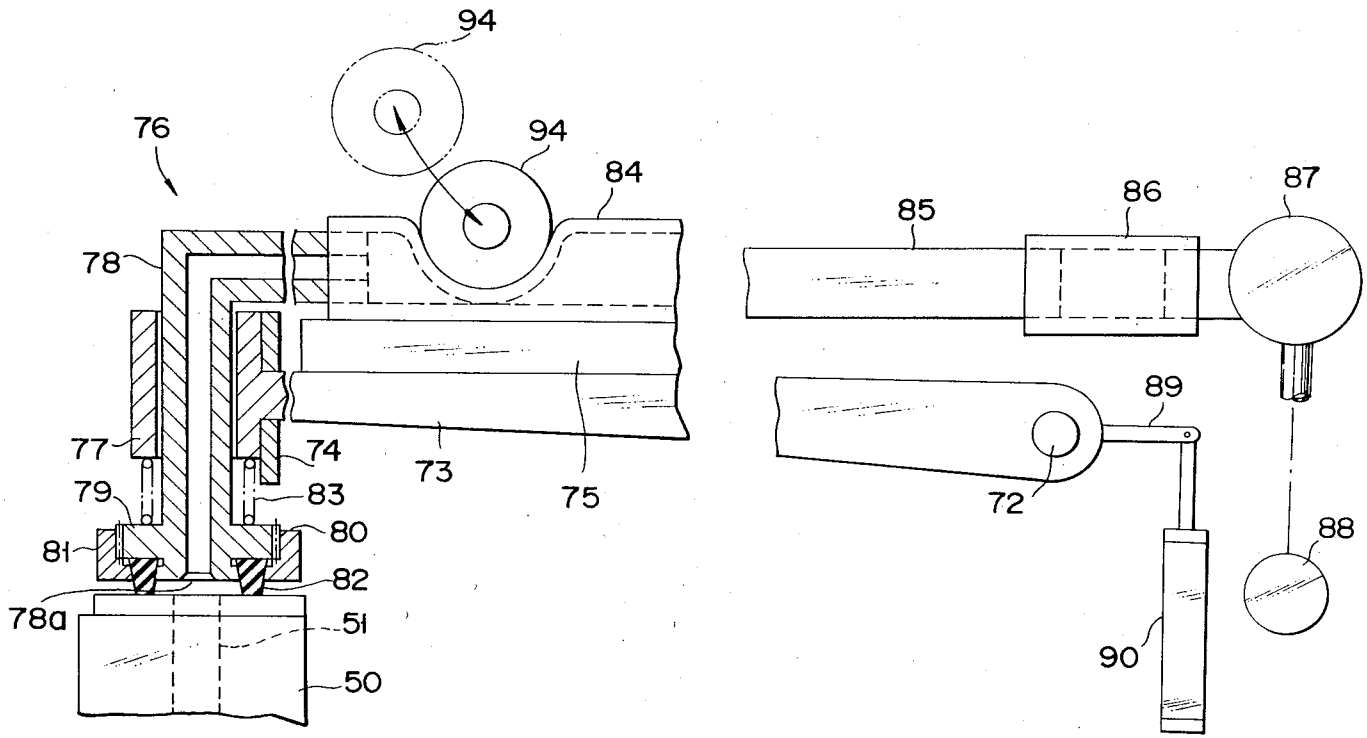
FIG. 9 is a side view showing the working head partially cut off.

As shown in FIG. 9, a link lever 89 is connected to the rotary shaft 72. The rod of a pneumatic cylinder 90, for example, is connected to the distal end of the link lever 89. When the carrier 20 is conveyed to and located at the position where the working heads 70 are located to effect the exhaust process, the rotary shaft 72 or each of the support arms 73 is rotated downward by the pneumatic cylinder 90. The pipe section 77 of each of the support arms 73 presses the flange 79 of the connecting pipe 78 at each of the second connecting pipe members 76 through the spring 83, so that each of the connecting pipes 78 is pushed downward, causing its seal rubber 82 to be air-tightly contacted with the upper surface of the connector 51 of each of the support heads 24 on the carrier 20. As a result, the second connecting pipe members 76 on the side of the working heads 70 are air-tightly connected to the first connecting pipe members 40 in the support heads 24 on the side of the carrier 20. When the vacuum pumps 88 are driven under this state, therefore, all of six bulbs 33 on the carrier 20 can be exhausted at the same time.

As shown in FIG. 3, a second pinch cock 91 which serves to open and close the inner passage of the rubber tube 84 is arranged at each of the second connecting pipe members 76 on the working heads 70. The second pinch cock 91 is adjacent to the rubber tube 84. The second pinch cock 91 comprises a supporting block 92 attached onto the support plate 75. A rotary arm 93 is rotatably supported at the center thereof by the supporting block 92 through a pin. A press roller 94 is attached to the lower end of the rotary arm 93 while the rod of a pneumatic cylinder 96 which is attached to the support plate 75 via a link 95 is attached to the upper end of the rotary arm 93. When the rotary arm 93 is rotated downward, therefore, the rubber tube 84 is pressed by the press roller 94, as shown in FIG. 9, thereby closing the inner passage of the rubber tube 84. When the rotary arm 93 is rotated in the reverse direction, the rubber tube 84 returns to its original pipe shape due to its elasticity thereby opening its inner passage.

Although the same working heads as the working head 70 are fixed at the mercury and argon gas introducing positions 13 and 14, they are different from the exhaust process working head 70 in that their second connecting pipe members are not connected to the vacuum pumps 88 but to mercury supply sources in the case of introducing mercury, and are connected to argon gas sources in the case of introducing argon gas.

The working heads, which are fixed at the lighting postions 12*a*–12*c* and aging position 16, have current supply terminals which are electrically connected to the terminals 64 of the chuck levers at the support heads 24 on the carrier 20. In this way, current can be applied to the filament coils of the bulbs through the current supply terminals of the working heads.

The working heads which are fixed at the tipping off positions 15*a*–15*d* may the conventional ones, and so a description of these working heads will be omitted.

According to the above-described example of the exhaust apparatus for ring-shaped bulbs, the carrier 20 whose support heads 24 hold the bulbs as described above is intermittently conveyed along a guide rail 19. The rubber tube 49 in each of the support heads 24 on the carrier 20 is pressed by the first pinch cock 52 under this state, thereby closing the first connecting pipe member 40. When the bulb 33 is held by each of the support head 24 on the carrier 20, the lead wires 65 and 66 of the bulb 33 are clamped by means of the two pairs of chuck levers 61 and 62, and are connected to the terminals 64.

Before the carrier 20 is conveyed to and located at each group of the working heads which are arranged at the exhaust positions 11*a*–11*e*, mercury introducing position 13 and argon gas introducing position 14, the second connecting pipe member 76 or the inner passage of the rubber tube 84 of each of the working heads is closed by the second pinch cock 91 as described above.

The carrier 20 is then intermittently positioned and temporarily stopped at the exhaust positon 11*a*. When the carrier 20 is positioned at the exhaust position 11*a*, each of the support arms 73 of the working heads 70 is rotated downward as described above and the connecting pipe 78 of the second connecting pipe member 76 is thus air-tightly connected to the connector 51 of the first connecting pipe member 40 at each of the support heads 24 on the carrier 20. Namely, the second connecting pipe memebers 76 on the side of the working heads 70 are air-tightly connected to the first connecting pipe members 40 on the side of the carrier 20. When the second pinch cocks 91 are opened and the vacuum pumps 88 are driven under this state, air in the inner passages of the second connecting pipe members 76 is exhausted. When the first pinch cocks 52 on the side of the carrier 20 are then opened, the second connecting pipe members 76 are air-tightly connected the exhaust tubes 33*a* of the bulbs 33 through the first connecting pipe members 40, thereby allowing the bulbs 33 to be exhausted for a predetermined time.

When the exhaust process is finished at the exhaust position 11*a*, both the first and second pinch cocks 52 and 91 on both sides of the carrier 20, and the working heads 70 are closed. Also, the second connecting pipe members 76 are separated from the first connecting pipe members 40.

When the exhaust process is finished at the exhaust position 11*a*, the carrier 20 is located at the exhaust positions 11*b*–11*e* and the same exhaust process is done.

The terminals 64 of the two pairs of chuck levers 61 and 62 on the side of the carrier 20 are electrically connected to the current supply terminals of the working heads at the lighting positions 12*a*–12*c* interposed along the exhaust positions 11*a*–11*e*. Current is thus allowed to flow through the filament coils of the bulbs 33. Oxide matter attached to these filament coils is decomposed accordingly.

When the exhaust process is finished at each of the exhaust positions as described above, the carrier 20 is successively conveyed to and located at the mercury and argon gas introducing positions 13 and 14. Instead of exhausting the bulbs 33, as described above, at the exhaust positions, mercury is introduced in the bulbs 33 through their exhaust tubes 33*a* at the mercury introducing position 13, and argon gas is introducing in the bulbs 33 at the argon gas introducing position 14.

The carrier 20 is then conveyed to and located at the tipping-off positions 15*a*–15*d*, and the exhaust tubes 33*a* of the bulbs 33 are tipped off and closed. When the carrier 20 is further located at the aging position 16, a current is allowed to flow through the filament coils of the bulbs 33 to effect the aging process.

Thereafter, the carrier 20 is conveyed to the unloading position 17 where the bulbs 33 are unloaded from the carrier 20. Next, the bulbs 33 which have been unloaded from the carrier 20 are conveyed to a base-attaching apparatus which attaches bases to the bulbs 33 thus making them complete.

According to an example of the exhaust apparatus of the present invention, the first pinch cock 52 of each of the support heads 24 is kept closed when the carrier 20 is being conveyed, thereby preventing air from carelessly entering the bulb 33. In this way, the exhaust, mercury and argon gas introducing processes can be satisfactorily done at each of the working positions.

According to the exhaust apparatus of the present invention, several bulbs (or six bulbs in this case) supported by a carrier 20 can be processed simultaneously, enabling fluorescent lamps to be mass produced.

Further, the conveyor 18 in the exhaust apparatus of the present invention can be shaped according to the space that is available, thereby preventing any space from being wasted after the exhaust apparatus is installed.

The exhaust apparatus of the present invention can be employed in the process of exhausting straightshaped fluorescent lamps, high-pressure discharge lamps, and incandescent lamps used as ring-shaped fluorescent lamps. The exhaust step of incandescent lamps includes only the above-described exhaust process and chopping off processes in incandescent lamps.

What is claimed is:

1. An apparatus for simultaneously exhausting a plurality of electric lamp bulbs and then simultaneously introducing a gas into said bulbs, comprising:

a guide rail located along a predetermined conveyance path, said conveyance path having a plurality of working positions disposed at predetermined locations along said conveyance path;

a plurality of carriers which are transferred along said guide rail such that said carriers are temporarily stopped at said working positions, said carriers including a plurality of carrier heads, each of said carrier heads having chuck means for removbly hoding a bulb, said bulb having an exhaust tube, a carrier pipe member having a carrier pipe internal passage, said carrier pipe member having first and second ends, said first end being connectable to said exhaust tube when said bulb is being held by said chuck means, and said second end being open, an exhaust tube connection means for connecting said first end of said carrier pipe member and said exhaust tube, and a carrier pipe valve disposed in said carrier pipe member for opening and closing said carrier pipe internal passage; and a plurality of working devices located at said working positions, said working devices including a plurality of working heads corresponding to said carrier heads, each of said working heads having a working pipe member having a working pipe internal passage and having at least one end, a working pipe connection means for detachably connecting said end of said working pipe member to said second end of said carrier pipe member when said carrier is stopped at said working position, and a working pipe valve disposed in said working pipe member for opening and closing said working pipe internal passage.

2. An apparatus according to claim 1, wherein:

said carrier pipe member of each of said carrier heads includes two metal pipe portions and a flexible, elastic pipe portion that connects said two metal pipe portions; and said carrier pipe valve of each carrier head includes a pinch cock for closing said elastic pipe portion by compressing said elastic pipe portion.

3. An apparatus according to claim 2, wherein:

at least part of said working pipe member of each of said working heads is flexible, elastic pipe; and said working pipe valve of each working head includes a pinch cock for closing said elastic pipe portion of said working pipe member by compressing said elastic pipe portion.

4. An apparatus according to claim 3, wherein said working pipe member of each of said working heads further includes an annular sealing member, located at said end of said working pipe member which contacts said second end of said carrier pipe member corresponding to said working pipe member when said end of said working pipe member is connected to said carrier pipe member.

5. An apparatus according to claim 1, wherein said chuck means of each of said carrier heads includes:

a main chuck for holding said bulb near said exhaust tube, said main chuck having a pair of main chuck rotary shafts which can be rotated in opposite directions, and a chuck claw attached to each of said main chuck rotary shafts; and an auxiliary chuck for holding said bulb at a position away from said exhaust tube, said auxiliary chuck having a pair of auxiliary chuck rotary shafts which can be rotated in opposite directions, and a chuck claw attached to each of said auxiliary chuck rotary shafts.

6. An apparatus according to claim 1, wherein said working pipe connection means includes a supporting means for movably supporting said working pipe member of each of said working heads, and a moving means for moving said end of said working pipe means for moving said end of said working pipe member to said second end of said carrier pipe member of said carrier corresponding to said working device.

7. An apparatus according to claim 6, wherein:

said moving means includes a rotary shaft, and a plurality of rotary arms each having first and second ends where said first end is attached to said rotary shaft and said second end is engaged with one of said working pipe members; and said end of said working pipe member contacts said second end of said carrier pipe member of said carrier corresponding to said working device and when said rotary arm engaged with said working pipe member is rotated, said end of said working pipe member connects with said second end of said carrier pipe member of said carrier corresponding to said working device.

8. An apparatus according to claim 7, wherein at least one of said main chuck rotary shafts of said main chuck is connected to at least one of said auxiliary chuck rotary shafts of said auxiliary chuck by a link, so that said main chuck can be opened and closed simultaneously with said auxiliary chuck.

9. An apparatus according to claim 8, wherein:

said bulb is generally annular and has first and second ends located close to each other, said exhaust tube extending from said first end of said annular bulb, and a pair of lead wires extending from both ends of said annular bulb; and said chuck means further includes a pair of lead wire chucks, attached to said main chuck rotary shafts, for holding said pair of lead wires extending from said bulb ends so as to connect said lead wires to each other when the bulb is held by said main chuck.

10. An apparatus according to claim 7, wherein said moving means further includes a spring disposed between said second end of each of said rotary arms, and a spring is disposed between said pipe portion and said end of said working pipe member.

11. An apparatus according to claim 10, wherein a pipe portion enclosing said working pipe member is provided at said second end of each of said rotary arms, and a spring is disposed between said pipe portion and said end of said working pipe member.

* * * * *